US006880456B2

(12) United States Patent
Viljanmaa

(10) Patent No.: US 6,880,456 B2
(45) Date of Patent: Apr. 19, 2005

(54) POLYMER COATING AND A METHOD FOR ADJUSTING THE PROPERTIES OF THE POLYMER COATING OF A ROLL OR A BELT

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 64 days.

(21) Appl. No.: 10/469,269

(22) PCT Filed: Feb. 26, 2002

(86) PCT No.: PCT/FI02/00155

§ 371 (c)(1),
(2), (4) Date: Aug. 27, 2003

(87) PCT Pub. No.: WO02/075049

PCT Pub. Date: Sep. 26, 2002

(65) Prior Publication Data

US 2004/0083906 A1 May 6, 2004

(30) Foreign Application Priority Data

Feb. 27, 2001 (FI) ..... 20010386

(51) Int. Cl.[7] ..... B30B 11/22

(52) U.S. Cl. ..... 100/41; 492/48; 492/56; 492/58

(58) Field of Search ..... 100/35, 41, 155 R, 100/176; 492/48, 56, 57, 59; 458/36.3, 36.4

(56) References Cited

U.S. PATENT DOCUMENTS

| | | | | |
|---|---|---|---|---|
| 6,253,671 | B1 | 7/2001 | Kayser | 100/35 |
| 6,682,467 | B1 * | 1/2004 | Zimmermann et al. | 492/50 |

FOREIGN PATENT DOCUMENTS

| | | |
|---|---|---|
| DE | 198 51 936 | 5/2000 |
| EP | 1 001 081 | 5/2000 |
| EP | 1 041 198 | 10/2000 |
| GB | 1 505 670 | 3/1978 |
| JP | 59-11220 | 1/1984 |
| JP | 5-280531 | 10/1993 |

* cited by examiner

*Primary Examiner*—Allen Ostrager
*Assistant Examiner*—Jimmy Nguyen
(74) *Attorney, Agent, or Firm*—Alfred A. Fressola; Ware, Fressola, Van Der Sluys & Adolphson LLP

(57) ABSTRACT

The invention relates to a method for adjusting the properties of the polymer coating (2) of a roll or a belt (3), whereby the roll or the belt is used for calendering a fibrous web (4) in a roll nip (N), which is formed between the roll or the belt and its backing roll (5), whereby the roll or the belt has a polymer coating comprising fibrous material (1). In the method, the thermal elongation coefficient and/or thermal conductivity of the polymer coating (2) are adjusted by directing the fibre direction of the fibrous material (1).

10 Claims, 1 Drawing Sheet

POLYMER COATING AND A METHOD FOR ADJUSTING THE PROPERTIES OF THE POLYMER COATING OF A ROLL OR A BELT

CROSS REFERENCE TO RELATED APPLICATIONS

This application is for entry into the U.S. national phase under §371 for International Application No. PCT/FI02/00155 having an international filing date of Feb. 26, 2002, and from which priority is claimed under all applicable sections of Title 35 of the United States Code including, but not limited to, Sections 120, 363 and 365(c), and which in turn claims priority under 35 USC §119 to Finnish Patent Application No. FI 20010386 filed on Feb. 27, 2001.

The invention relates to the method for adjusting the properties of the polymer coating of a roll or a belt.

The invention also relates to a polymer coating of a roll or a belt.

BACKGROUND OF THE INVENTION

When a fibrous web is calendered in a roll nip, which is formed in the nip between a polymer-coated roll or belt and the basking roll thereof, breaks in the track of the fibrous web or a foreign object drifting through the roll nip can easily cause damage in the polymer coating. Generally, damage in the coating material of a polymer-coated roll or belt is the result of an foreign object, such as a piece of tape, a spot of paste, etc., adhered to the fibrous track or the surface of the roll that causes temporary overload of the roll nip. The so-called packaging of the roll caused by a break in the fibrous web may also cause momentary overloading, i.e., a pressure peak in the roll nip. Overloading can also be caused by a transverse error in the profile of the paper web, causing a continuous pressure peak in the roll nip.

SUMMARY OF THE INVENTION

The purpose of the invention is to eliminate the disadvantages of prior art. The main object of the invention is to provide an arrangement, which effectively prevents damage to the polymer coating of the roll or the belt, which are caused by overloading the polymer coating, when the fibrous web is calendered in the roll nip.

The state of overload can cause immediate damage to the polymer coating, or the momentary overload of the roll nip can cause heat production in the polymer coating. Heat production causes a local pressure increase in the polymer coating because of thermal expansion, which further increases local deformation. This causes further local heat production in the polymer coating. The state of overload thus easily causes a self-feeding local deformation in the polymer coating, easily resulting in damage to the polymer coating.

The invention is based on the basic idea that the thermal elongation coefficient and/or the thermal conductivity of the polymer coating of the roll or the belt in the radial direction of the roll is arranged so that the polymer coating in the radial direction of the roll expands much less than normally. This is provided by the fibre direction of the fibrous material of the roll coating being at least partially in the radial direction of the roll. As the thermal conductivity of the fibres in the radial direction of the roll is good and their thermal elongation coefficient is small or even negative, the increase in local heat production only results in a minor expansion of the coating, or even in local reduction in the radial direction of the roll, effectively preventing damage to the polymer coating.

As the thermal elongation coefficient of the polymer coating in the radial direction of the roll is minor, no self-feeding local deformation described above is produced in the polymer coating used in the arrangement according to the invention. By further arranging the thermal conductivity of the polymer coating in the radial direction of the roll high, heat increase in the polymer coating is further reduced and damage is effectively prevented.

In the method according to the invention, the properties of the polymer coating of the roll or the belt are adjusted, when the fibrous web is calendered in the roll nip formed between the roll or the belt and its backing roll, whereby the roll or the belt has a polymer coating comprising fibrous material, and the thermal elongation coefficient and/or thermal conductivity are adjusted by directing the fibre direction of the fibrous material.

The radial direction of the roll herein refers to the direction of the roll radius at a certain point on the roll surface. If we are talking about a belt, the radial direction of the roll refers to the perpendicular direction of the belt.

The thermal elongation coefficient of the polymer coating material used in the arrangement is preferably minor in the radial direction of the roll and/or the thermal conductivity of the polymer coating material in the radial direction of the roll is high.

The polymer coating mainly consists of fibrous material and resin. The fibrous material is preferably carbon fibre or aramid fibre. Carbon fibre is an extremely good heat conductor, and its thermal expansion coefficient in the longitudinal direction of the fibre is negative. Thus, one advantage of polymer coating manufactured from carbon fibre reinforced resin is both good thermal conductivity and a negative thermal expansion coefficient in the longitudinal direction of the fibre.

In a preferred embodiment of the invention, the thermal elongation coefficient of the fibrous material is arranged to be zero or negative in the radial direction of the roll by directing the longitudinal direction of the fibrous material fibres so that it mainly diverges by 45 degrees at a maximum from the radial direction of the roll. When the direction of the fibres from the radial direction of the roll is 45 degrees at a maximum, this provides the advantage that local heating of the polymer coating causes a local reduction in the polymer coating or the coating to remain the same.

EP patent publication 1 001 081 discloses a supercalendering method of fibrous web, wherein the selection of the roll coating material is intended to provide the fibrous web with desired transparency properties. Similar fibre structures are used in the roll coating as in the invention, but the direction of the fibres is the same as that of the roll surface. Instead, the purpose of the present patent application is to prevent damage to the roll coating by adjusting the thermal elongation coefficient and/or thermal conductivity of the polymer coating. In that case, the fibre direction of the roll coating material fibres is selected so that it is at least partially in the radial direction of the roll.

The polymer coating used in the arrangement according to the invention provides the following additional advantages, among others:

Normally, the elasticity modulus of the polymer coating is adjusted by means of the ratio of the filler of the polymer coating to the resin. The elasticity modulus of the carbon fibre present in the polymer coating according to the invention is very high, whereby the elasticity modulus or the resilience of the polymer coating can be adjusted within a very large range by also changing the ratio of the resin to the carbon fibre, and/or by varying the quality of the resin. In that case, the polymer coating according to the invention can be used, when very different paper and cardboard qualities are calendered.

The glass transition temperature, Tg, of carbon fibre reinforced laminating resins is more than 150° C. or even over 200° C., whereby the polymer coatings made of these laminates endure very high calendering temperatures without suffering from permanent deformation.

It is possible to coat the roll (or the belt) with laminating resins by means of various methods, among others, by spreading, reeling, injecting or sizing a thin laminated tube on the surface of the roll, etc. The roll can be, among others, a polymer coated steel roll or paper roll. The coating can also be manufactured by laminating thin laminated discs on top of the roll axis, the fibre direction thereof being as desired. Thus, it is possible to manufacture polymer coatings made of laminated carbon fibre by means of various alternative methods, making it possible to use the polymer coating as a coating material of rolls and belts intended for various targets of calendering.

It is easy to renew the outer layer of carbon fibre or aramid fibre reinforced polymer coatings, for example, by spreading and hardening a new surface layer.

BRIEF DESCRIPTION OF THE DRAWING

In the following, the invention is described in detail with reference to the appended drawing.

DETAILED DESCRIPTION

Figure 1:
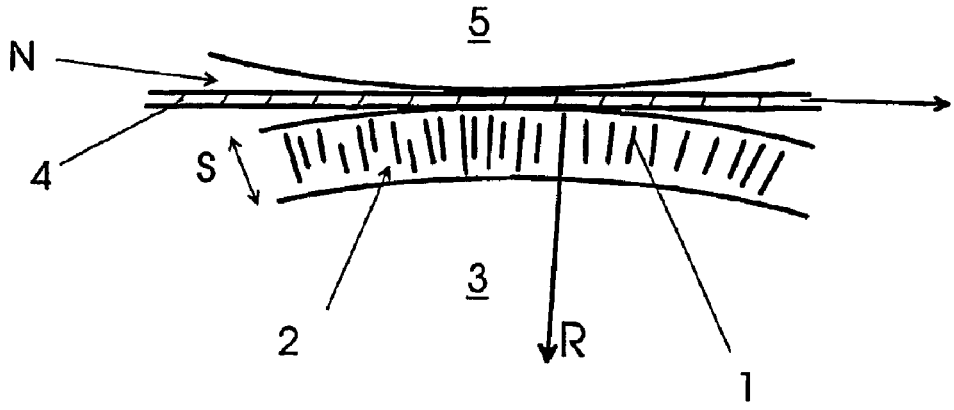
FIG. 1 shows a schematic cross-sectional view of part of the roll coating.

As viewed from the end of a roll nip, FIG. 1 shows the roll nip between two rolls. The roll nip N is formed between a heated hard thermo roll 5 and a polymer coated roll 3 opposite the thermo roll. A fibrous web 4 travels in the roll nip N between the rolls, the surface of the web being calendered, when the web travels through the roll nip between the rolls from left to right. A polymer coating 2 on top of the roll 3, the thickness of which is s, consists of epoxy resin, carbon fibre, and a filling agent. The fibre direction of the carbon fibre 2 is mainly the same as the direction of the radius R of the roll. If a foreign object enters the roll nip along with the fibrous web, for example, it causes local heating of the polymer coating. Local heating of the polymer coating causes a reduction in the polymer coating in its perpendicular direction, i.e., the radial direction R of the roll, which in turn results in cooling of the fibrous web.

The behaviour of a roll coating coated with the polymer coating according to the invention is described above, when it heats locally. If the polymer coating is on top of the belt of a belt calender, the fibre direction of fibres 1 is mainly arranged in the perpendicular direction s of the belt.

What is claimed is:

1. A method for adjusting the properties of the polymer coating (2) of a roll or a belt (3), whereby the roll or the belt is used for calendering a fibrous web (4) in a roll nip (N), which is formed between the roll or the belt and its backing roll (5), whereby the roll or the belt has a polymer coating comprising fibrous material (1), characterized in that the thermal elongation coefficient and/or thermal conductivity of the polymer coating (2) are adjusted by directing the fibre direction of the fibrous material (1), so that the locally increased heat production of the polymer coating (2) results in a minor expansion or local reduction of the polymer coating at least in the radial direction (R) of the roll.

2. A method according to claim 1, characterized in that in the method, the elasticity of the polymer coating (2) is further adjusted by changing the proportion of the fibrous material and the resin contained by the polymer coating with respect to one another.

3. A method according to claim 2, characterized in that the polymer coating (2) are adjusted by directing the fibre direction of the fibrous material by 45 degrees from the radial direction (R) of the roll at a maximum.

4. A method according to claim 3, characterized in that the fibrous material (1) is carbon fibre.

5. A method according to claim 4, characterized in that the fibrous material (1) is aramid fibre.

6. A method according to claim 5, characterized in that the roll (3) is a paper roll.

7. A method according to claim 1, characterized in that the polymer coating (2) are adjusted by directing the fibre direction of the fibrous material by 45 degrees from the radial direction (R) of the roll at a maximum.

8. A method according to claim 1, characterized in that the fibrous material (1) is carbon fibre.

9. A method according to claim 1, characterized in that the fibrous material (1) is aramid fibre.

10. A method according to claim 1, characterized in that the roll (3) is a paper roll.

* * * * *

UNITED STATES PATENT AND TRADEMARK OFFICE

CERTIFICATE OF CORRECTION

PATENT NO. : 6,880,456 B2
DATED : April 19, 2005
INVENTOR(S) : Mika Viljanmaa

It is certified that error appears in the above-identified patent and that said Letters Patent is hereby corrected as shown below:

Column 1,
Line 24, please delete the word "basking" and replace with -- backing -- therefor.
Line 28, please delete the word "an" and replace with -- a --.

Signed and Sealed this

Ninth Day of August, 2005

JON W. DUDAS
*Director of the United States Patent and Trademark Office*